US005581341A

United States Patent [19]

Tanaka

[11] Patent Number: 5,581,341

[45] Date of Patent: Dec. 3, 1996

[54] TEMPERATURE CONTROL DEVICE FOR A FUSING DEVICE IN AN IMAGE FORMING APPARATUS

[75] Inventor: Yoshihisa Tanaka, Osaka, Japan

[73] Assignee: Mita Industrial Co., Ltd., Osaka, Japan

[21] Appl. No.: 389,336

[22] Filed: Feb. 14, 1995

[30] Foreign Application Priority Data

Feb. 25, 1994 [JP] Japan ..... 6-027980

[51] Int. Cl.[6] ..... G03G 15/20

[52] U.S. Cl. ..... 355/285; 219/216

[58] Field of Search ..... 355/282, 285, 355/289, 290, 208; 219/216

[56] References Cited

U.S. PATENT DOCUMENTS

| | | | |
|---|---|---|---|
| 4,822,977 | 4/1989 | Leising et al. | 219/216 |
| 4,836,442 | 6/1989 | Beckey . | |
| 4,914,476 | 4/1990 | Nishitsuji et al. . | |
| 4,920,250 | 4/1990 | Urban | 219/216 |
| 5,140,132 | 8/1992 | Shiokawa | 219/216 |
| 5,287,154 | 2/1994 | Nakai et al. | 355/285 |
| 5,289,247 | 2/1994 | Takano et al. | 355/285 |
| 5,331,384 | 7/1994 | Otsuka . | |

FOREIGN PATENT DOCUMENTS

| | | |
|---|---|---|
| 0483869A2 | 5/1992 | European Pat. Off. . |
| 0534417A2 | 3/1993 | European Pat. Off. . |

OTHER PUBLICATIONS

European Search Report dated Nov. 13, 1995.

*Primary Examiner*—Robert Beatty

*Attorney, Agent, or Firm*—Beveridge, DeGrandi, Weilacher & Young, LLP

[57] ABSTRACT

A temperature control device for a fusing device in an image forming apparatus includes a heater provided in the fusing device for heating a sheet of paper, a temperature detector for detecting the temperature at the fusing device, and a temperature controller for regulating the heater based upon a difference in temperature at the fusing device before and after a sheet of paper passes the fusing device.

16 Claims, 6 Drawing Sheets

| ① | ② | ③ | ④ | ⑤ |
|---|---|---|---|---|
| TEMP. A | TEMP. B | (A−B) | ATMOSPHERIC TEMP. | VARIED TEMP. |
| 190 | 180 | 10 | 35 | −10 |
| 190 | 170 | 20 | 25 | 0 |
| 190 | 160 | 30 | 15 | 10 |
| 190 | 150 | 40 | 5 | 18 |

FIG. 7

| (A−B) \ C | 30 | 40 | 50 | 60 |
|---|---|---|---|---|
| 10 | 90 | 85 | 65 | 45 |
| 20 | 85 | 65 | 45 | 30 |
| 30 | 65 | 45 | 30 | 20 |
| 40 | 50 | 35 | 25 | 15 |

TEMPERATURE CONTROL DEVICE FOR A FUSING DEVICE IN AN IMAGE FORMING APPARATUS

BACKGROUND OF THE INVENTION

1. Field of the Invention

The present invention relates to a temperature control device for a fusing device in an image forming apparatus, and more particularly, it relates to a temperature control device for a fusing device in an image forming apparatus where the fusing device thermally fuses a toner image on a sheet of paper.

2. Description of the Related Art

A fusing device for fusing a toner image on a sheet of paper is used for an image forming apparatus such as a copying machine, a facsimile machine and the like. The fusing device includes a thermal roller having a heating means like a heater and a press roller for pressing against the thermal roller, and the toner image is thermally fused on the sheet of paper pressed between the thermal roller and press roller.

In such a fusing device, a thermistor for detecting a surface temperature of the thermal roller is attached to a housing enclosing the thermal roller, and temperature data obtained by the thermistor is applied to a temperature regulating device for regulating a heater provided in the thermal roller.

3. Disadvantages

Temperature control to a fusing device must be highly accurate because it is influential in fusibility of a toner image and occurrence of wrinkles in a sheet of paper. Although accurate temperature detection is needed, sometimes a temperature of a supplied sheet of paper is different from the atmospheric temperature within the image forming apparatus, especially, the temperature at the surface of the sheet of paper is different from the atmospheric temperature immediately after the sheet of paper is put in a sheet cassette, and in such a situation, the sheet of paper supplied to the fusing device is pressed against the thermal roller to change a temperature at the surface of a thermal roller. This results in fusibility of the toner image varying from one sheet to another.

A temperature sensor like a thermistor merely measures the temperature at the surface of the thermal roller in the fusing device or the atmospheric temperature within the fusing device. Humidity within the fusing device is one of major causes of occurrence of wrinkles in the sheet of paper in the fusing device. Thus, it is insufficient controlling the temperature at the fusing device based upon the temperature at the surface of the thermal roller or the atmospheric temperature within the fusing device in order to prevent the occurrence of wrinkles in the sheet of paper in the prior art image forming apparatus.

SUMMARY OF THE INVENTION

An object of the present invention is a stable performance of fusing a toner image in an image forming apparatus.

Another object of the present the invention is to prevent occurrence of wrinkles in a sheet of paper in an image forming apparatus.

A temperature control device for a fusing device in an image forming apparatus in one aspect of the present invention includes a heating means, a temperature detecting means and a temperature control means. The heating means is placed in the fusing device to heat a sheet of paper. The temperature detecting means detects a temperature at the fusing device. The temperature control means regulates the heating means based upon a difference in temperature at the fusing device before and after the sheet of paper passes the fusing device.

The temperature control means preferably has a temperature control table based upon the difference in temperature of the fusing device before and after the sheet of paper passes there, and in such a case, the temperature control means regulates the heating means in accordance with the temperature control table.

The temperature detecting means is preferably a thermistor.

A temperature control device for a fusing device in an image forming apparatus in another aspect of the present invention has a heating means, a first temperature detecting means, a second temperature detecting means, and a temperature control means. The heating means is placed in the fusing device to heat a sheet of paper. The first temperature detecting means detects a temperature at the fusing device. The second temperature detecting means detects a temperature of things other than the fusing device in the image forming apparatus. The temperature control means regulates the heating means based upon detection results by the first and second temperature detecting means, and in this situation, the detection result by the first detecting means is a difference in temperature at the fusing device before and after the sheet of paper passes there.

The temperature control means preferably has a temperature control table based upon the temperature difference at the fusing device before and after the sheet of paper passes there, and a humidity table based upon the temperature difference and the temperature detected by the second temperature detecting means, and in this situation, the temperature control means regulates the heating means in accordance with the temperature control table and the humidity table.

The first temperature detecting means is preferably a thermistor, and the second temperature detecting means is also preferably a thermistor disposed on the same substrate with the temperature control means.

Features of the Invention

In a temperature control device for a fusing device according to the present invention, a temperature detecting means detects temperatures at the fusing device before and after a sheet of paper passes there. A heating means is regulated based upon a difference in temperature at the fusing device before and after the sheet of paper passes there. In this way, fusibility of a toner image is prevented from varying from a sheet to another because of a temperature change by the temperature of the sheet of paper.

The temperature control means has a temperature control table based upon the difference in temperature before and after the sheet of paper passes the fusing device, and thus, simplification of the control can be attained as well as the effect similar to the above in regulating the heating means in accordance with the temperature control table. When a thermistor is employed as the temperature detecting means, the effects as mentioned above become increasingly remarkable.

In a temperature control device for a fusing device in another aspect of the present invention, a heating means is regulated based upon a temperature difference at the fusing device before and after a sheet of paper passes there and temperatures at things other than the fusing device. Herein, fusibility of the resultant toner image can be prevented from varying from a sheet of paper to another because of a temperature change by temperature of the sheet of paper, and additionally, occurrence of wrinkles in the sheet of paper due to humidity in the fusing device can be avoided.

A temperature control means has a temperature control table based upon the temperature difference before and after the sheet of paper passes the fusing device and a humidity table based upon the temperature difference and temperatures detected by a second temperature detecting means, and simplification of the control can be attained in regulating the heating means in accordance with the temperature control table and the humidity table.

When a thermistor is employed as a first temperature detecting means, the effects as mentioned above become increasingly remarkable. In addition to that, when a thermistor is also employed as the second temperature detecting means displaced on the same substrate with the temperature control means, more accurate control can be attained, and the effects as mentioned above become more remarkable.

These and other objects, features, aspects and advantages of the present invention will become more fully apparent from the following detailed description of the present invention when taken in conjunction with the accompanying drawings where like reference numerals denote corresponding parts throughout, in which:

BRIEF DESCRIPTION OF THE DRAWINGS

FIG. 7 is a humidity table as employed in the present invention.

DETAILED DESCRIPTION OF THE DRAWINGS

First Embodiment

Figure 1:
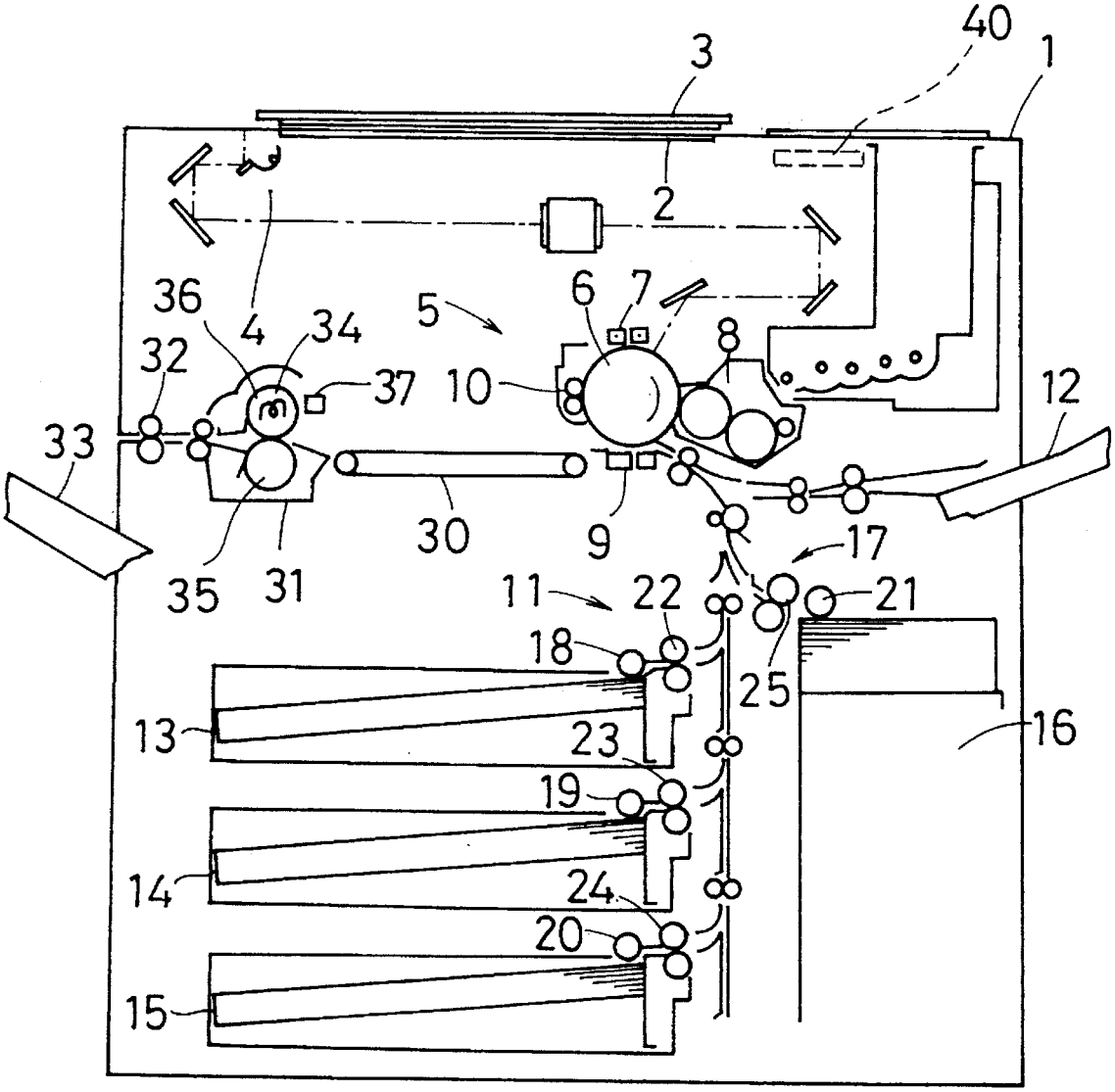
FIG. 1 is a side cross-sectional schematic view of a photocopying machine having a temperature control device in accordance with one embodiment of the present invention.

FIG. 1 depicts a copying machine in accordance with a first embodiment of the present invention. Referring to FIG. 1, an original plate 2 is fixed on top of a machine body 1, and an original holder 3 is hinged to the original plate 2.

Within the machine body 1 and in an upper portion adjacent to the original plate 2, an exposing device 4 is positioned to read an original document (not shown) which may be placed on the original plate 2. The exposing device 4 includes a light source, mirrors, and lenses. In the center of the machine body 1, an image forming device 5 is disposed to form a toner image on a piece of paper, the toner image in accordance with the image read by the exposing device 4 from the original document (not shown) positioned on the original plate 2. The image forming device 5 includes a photoconductor drum 6 which has a surface which allows the formation of an electrostatic latent image in response to images read by the exposing device 4. The photoconductor drum 6 is surrounded by a electrostatic charger 7, a developing device 8, a transfer/separation device 9, and a cleaning device 10.

In a lower part within the machine body 1, a sheet supplying device 11 is provided. The sheet supplying device is comprised of a bypass table 12 at the right side of the machine body 1 in FIG. 1, three sheet supplying cassettes 13, 14 and 15 stacked at the lower half within the machine body 1, a large sheet supplying cassette 16 on the right side of the sheet supplying cassettes 13, 14 and 15, and a sheet feeder 17 for feeding sheets of paper contained in the sheet supplying cassettes 13 to 16 to the image forming device 5. The sheet feeder 17 includes sheet supplying rollers 18, 19, 20 and 21 for respectively taking an uppermost mass of sheets of paper each from the sheet supplying cassettes 13, 14, 15 and 16, and loosening rollers 22, 23 24 and 25 for respectively loosening from a tight mass of the sheets of paper so that only single sheets of paper are moved at one time.

Downstream from the image forming device 5 in the process line, there are disposed a sheet conveyer 30 for sending the sheets of paper to the left in the machine body 1 in FIG. 1, a fusing device 31 for fusing a toner image on the sheets of paper, a discharge roller 32 for discharging the sheets of paper where the image has been fused, and a sheet tray 33 for receiving the discharged sheets of paper. The fusing device 31 has a thermal roller 34 having a heater 36 therein, and a press roller 35 for pressing against the thermal roller 34. A thermistor 37 is provided close to the thermal roller 34 to measure a temperature at surface of the thermal roller 34.

Figure 2:
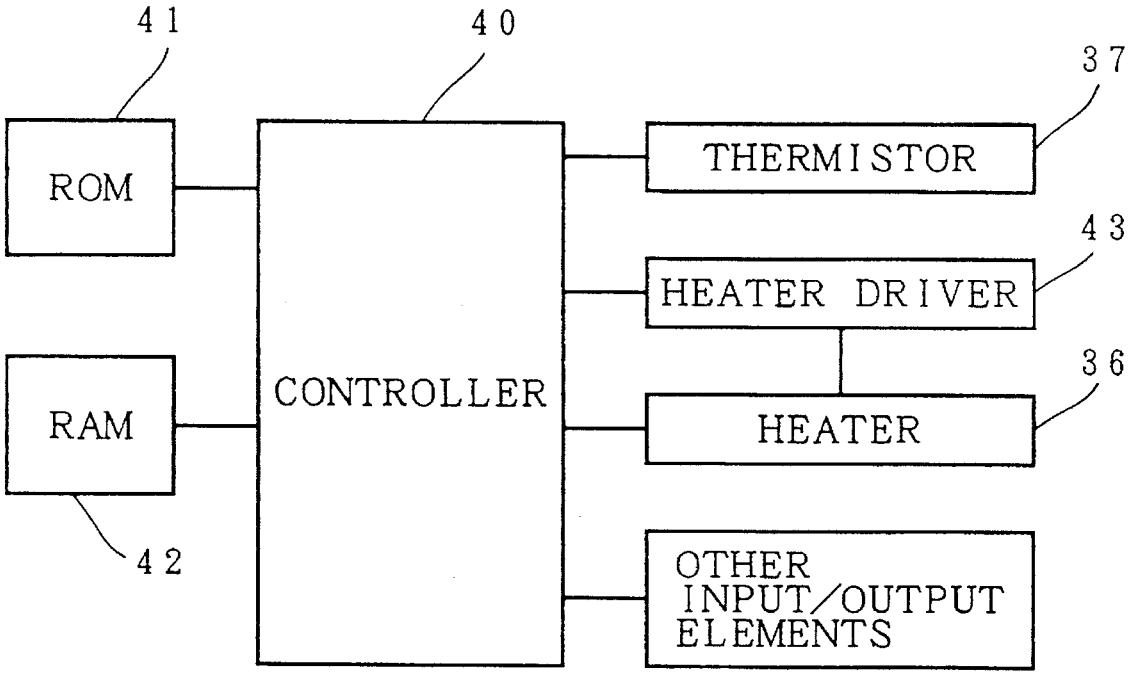
FIG. 2 is a block diagram showing various elements electrically connected to a controller of the photocopying machine in FIG. 1.

The machine body 1 is further provided with a controller 40 as shown in FIGS. 1 and 2. The control device 40 is an integrated microcomputer including a Central Processing Unit or CPU (not shown), RAM (Random Access Memory) 42, ROM (Read Only Memory) 41, and is connected to the thermistor 37, a heater driver 43, the heater 36 and other various Input/Output elements. The ROM 41 in the controller 40 is programmed with a control program, a reference table and other digital data necessary for controlling the elements in the machine body 1. The RAM 42 typically stores various data relating to operations of the photocopying machine in the machine body 1. The controller 40 is connected to the thermistor 37 for measuring temperature at the surface of the thermal roller 34. A heater driver 43, connected to the controller 40, regulates the heater 36 in accordance with temperature data received from the thermistor 37.

The operation of this embodiment will be described below in conjunction with a flow chart shown in FIG. 3.

At Step S1, the controller 40 determined whether or not a preheating mode is necessary. If affirmative, the controller 40 proceeds to Step S2 where the heater 36 is regulated so that the fusing device 31 reaches a specified preheating temperature level. If the preheating mode does not need to be implemented, or if the preheating mode has been bypassed or canceled, the procedure moves from Step S1 to Step S3. At Step S3, control of the photocopier in the machine body 1 moves into a standby mode where the heater 36 is regulated so that the fusing device 31 maintains an appropriate temperature level for copying.

At Step S4, the controller 40 determines whether or not a print key (not shown) has been manipulated. If affirmative, the procedure proceeds from Step S4 to Step S5. At Step S5, a sheet of paper is supplied from either the bypass table 12 or one of the sheet supplying cassettes 13, 14, 15 or 16, to the image forming device 5. At Step S6, a current temperature (before the sheet of paper passes the fusing device 31) is received from the thermistor 37 to store as a temperature A in the RAM 42. At Step S7, a toner image is formed on the sheet of paper in the image forming device 5, and thereafter, the toner image formed on the sheet of paper is fused by the fusing device 31. At Step S8, the sheet of paper is discharged into the sheet tray 33. At Step S9, a current temperature (after the sheet of paper passes the fusing device 31) is received from the thermistor 37 to store as a temperature B in the RAM 42. At Step S10, a difference between the temperature A and the temperature B is calculated. At Step S11, the controller 40 checks a temperature control table (see FIG. 4) stored in the ROM 41 and compares the value of the difference between temperature A and temperature B, in accordance the calculation at Step S10. At Step S12, the heater 36 is regulated based upon a temperature in the temperature control table to which reference is made at Step S11. After that, the procedure returns to Step S4. If the print key is not manipulated at Step S4, another processing step is executed at Step S13, and the procedure returns to Step S1.

Figure 3:
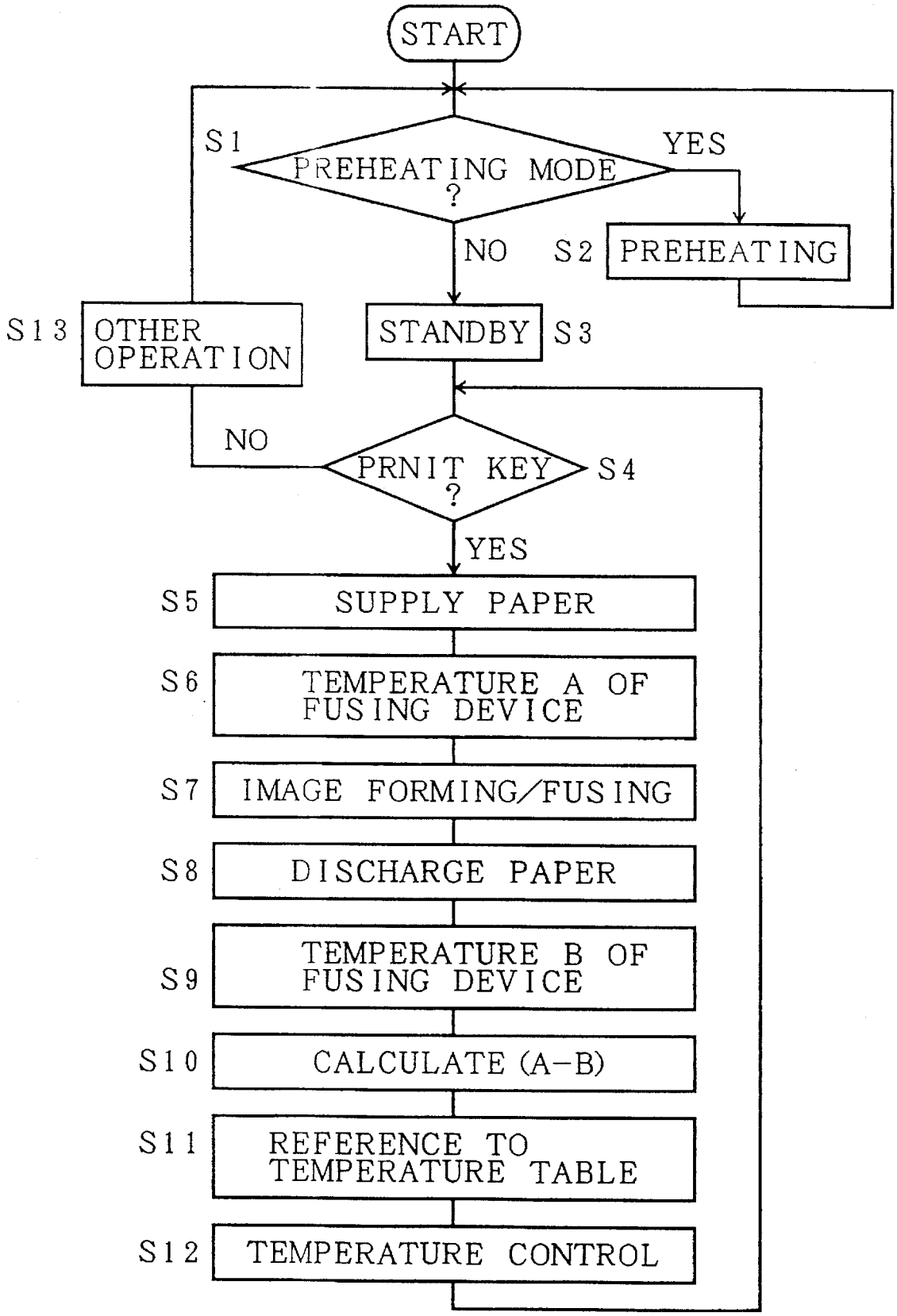
FIG. 3 is a flow chart illustrating several controller functions or steps of the copying machine depicted in FIGS. 1 and 2.
Figures 4, 5:
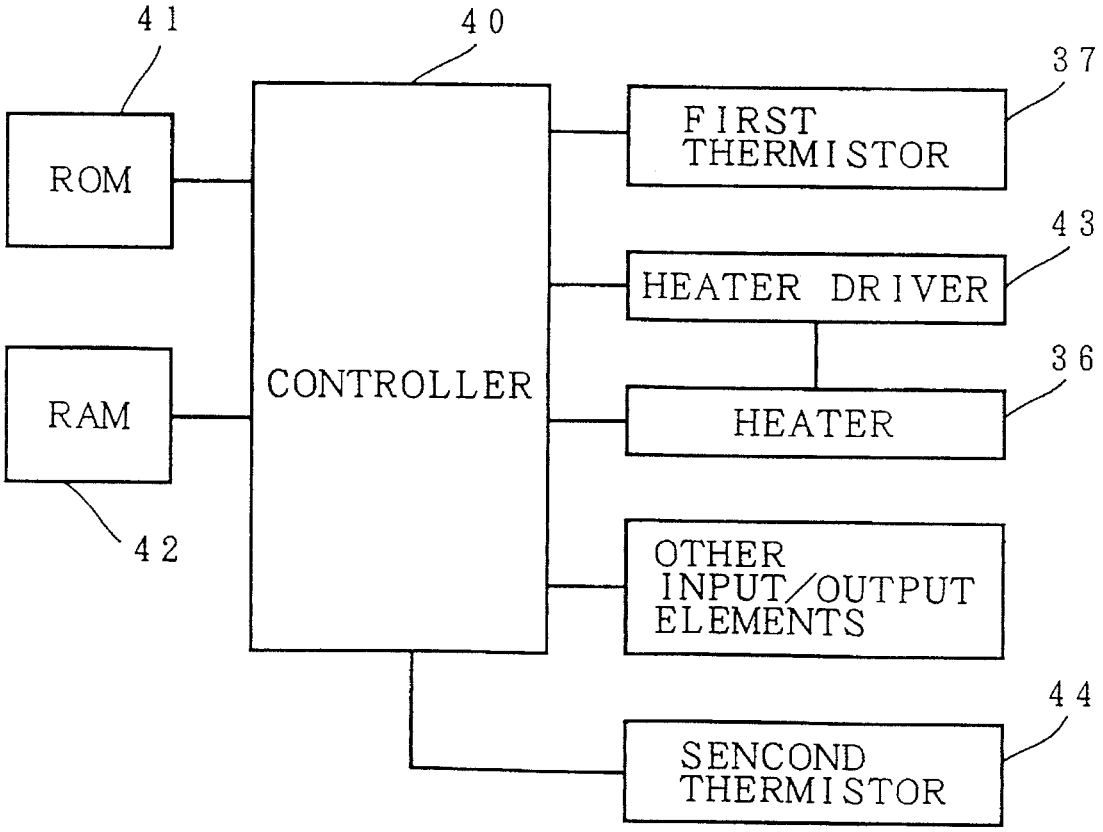
FIG. 4 is a temperature control table as employed in one embodiment of the present invention.
FIG. 5 is a block diagram showing various elements electrically connected to a controller of the photocopying machine in accordance with another embodiment of the present invention.

FIG. 4 shows an example of the temperature control table to which reference is made at Step S11 in FIG. 3, where numerical values are all represented in °C. Column 1 contains data on temperature from the thermistor 37 (the temperature) before the sheet of paper passes the fusing device 31 while column 2 contains data on temperature from the same (the temperature B) after the sheet of paper passes the fusing device 31. Column 3 has data on the difference in temperature (A–B) before and after the sheet of paper passes the fusing device 31. Column 4 shows data on the atmospheric temperature presumed from the temperature A in Column 1 and the temperature difference (A–B) in Column 3. Column 5 shows values of temperature to be varied for regulation by the heater driver 43, which are determined based upon the atmospheric temperature in Column 4. In FIG. 4, the temperature at the fusing device 31 in a normal copying operation is set to 190° C. A target value for the regulation by the heater driver 43 is determined so that the heater 36 may recover itself at 190° C. after the sheet of paper passes the fusing device 31 at the atmospheric temperature of 25° C. The target value of the heater driver 43 is lowered when the atmospheric temperature is higher than 25° C. while it is raised when the atmospheric temperature is lower than 25° C., so that a period of time till the heater 36 recovers its normal temperature (190° C.) can be shortened.

Second Embodiment

FIG. 5 is a block diagram showing a controller 40 controlling system architecture in accordance with a second embodiment of the present invention. Like reference numerals denote corresponding parts to those in the previous preferred embodiment, and explanation about them is omitted. For instance, a first thermistor 37 is connected to the controller 40, as described with respect to the first embodiment depicted in FIG. 2. A second thermistor 44 connected to the controller 40 may be mounted, for instance, adjacent to or inside the controller 40 to measure temperatures of things other than the fusing device 31 within a temperature control device in an image forming apparatus. For instance, the second thermistor 44 may measure the ambient temperature within the machine body 1, or the temperature of the paper supply trays 13, 14, 15 and/or 16. Indeed the second thermistor 44 could be disposed in any of a variety of positions, depending upon the configuration and intended use of the device in the machine body 1. Further, in the instance where the second thermistor 44 is disposed on or inside the controller 40, the controller itself could be mounted in a variety of positions within the machine body 1, depending upon the configuration and intended use of the device in the machine body 1.

In this embodiment, the operation of the temperature control device will be explained in conjunction with a flow chart shown in FIG. 6.

Figure 6:
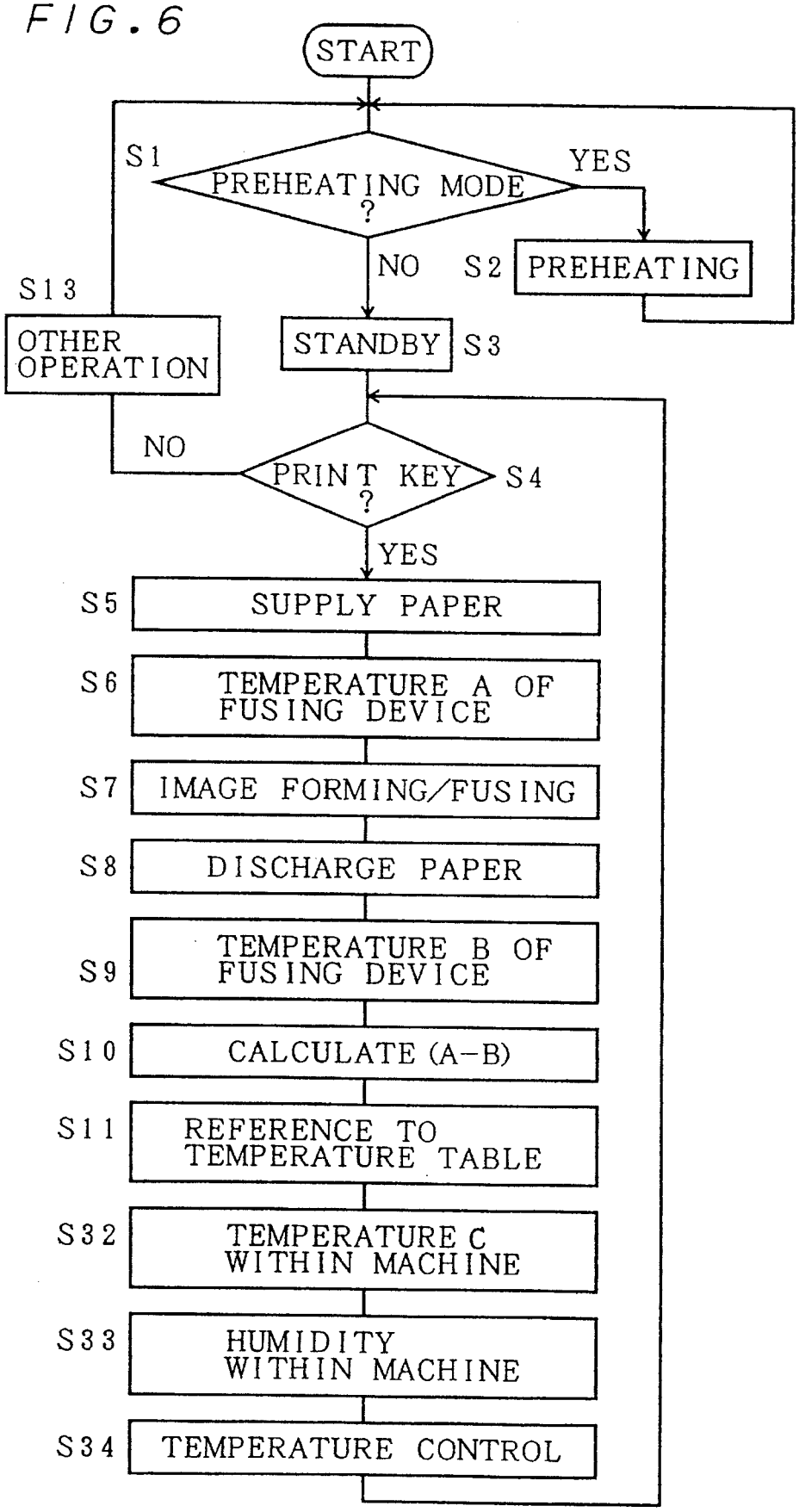
FIG. 6 is a flow chart illustrating several controller functions or steps of the copying machine in accordance with the embodiment of the invention depicted in FIG. 5.

In FIG. 6, Steps S1 through S11 and S13 are generally the same as Step S1 through S11 and S13 described above with respect to FIG. 3, and therefore, explanation of them is omitted. However, at Step S32, temperature data is received from the second thermistor 44 and stored as an inner temperature C in a RAM 42. At Step S33, a humidity D is determined within the apparatus based upon a temperature difference (A–B) before and after passage of a sheet of paper which is obtained at Step S10 by making reference to a humidity table stored in a ROM 41. At Step S34, a temperature at the fusing device 31 is varied based upon the temperature difference (A–B) and the humidity D within the apparatus.

An example of the humidity table to which reference is made at Step S33 is depicted in FIG. 7. If the temperature difference (A–B) is 10° C. and the inner temperature C is 30° C., it is found that the humidity D is 90%, or otherwise if the temperature difference (A–B) is 40° C. and the inner temperature C is 60° C., it is found that the humidity D within the apparatus is 15%. The temperature at the fusing device 31 is to be set high when the humidity D determined at Step S33 is high while it is to be set lower than an ordinary level when the humidity D is low, and thus, occurrence of wrinkles in the sheet of paper due to the humidity D within the apparatus can be prevented.

Moreover, since a temperature at a heater is varied for allowing a current temperature on the sheet of paper, fusibility of toner can be prevented from varying from a sheet of paper to another.

Although not shown herein, a temperature at the fusing device 31 regulated based upon the temperature difference (A–B) and the humidity D may be stored as a temperature control table in the ROM 41.

As has been described in a temperature control device for a fusing device in an aspect of the present invention, a heating means for heating a sheet of paper is regulated based upon a difference in temperature at the fusing device before and after the sheet of paper passes the fusing device, and thus, variation in fusibility of a toner image due to a change in temperature by the sheet of paper is inhibited.

When a temperature control means has a temperature control table based upon the difference in temperature before and after the sheet of paper passes the fusing device to regulate the heating means in accordance with the temperature control table, the reliability of the photocopier as described above becomes more consistent as the control of the temperature is facilitated. When a thermistor is employed as a temperature detecting means, also the above-mentioned effect becomes more pronounced.

In a temperature control device for a fusing device in another aspect of the present invention, a heating means is regulated based upon a temperature difference at the fusing device before and after a sheet of paper passes there and temperatures of things other than the fusing device, and therefore, variation in fusibility of a toner image due to a change in temperature by the sheet of paper and occurrence of wrinkles in the sheet of paper due to humidity in the fusing device can be reduced.

When a temperature control means has a temperature control table based upon a temperature difference before and after the sheet of paper passes the fusing device and a humidity table based upon the temperature difference and a temperature detected by a second temperature detecting means to regulate the heating means in accordance with the temperature control table and the humidity table, the effect as mentioned above becomes more pronounced, and the control of temperature is facilitated.

When a thermistor is employed as a first temperature detecting means, the above-mentioned effect becomes more effective. In addition to that, when the second temperature detecting means is a thermistor arranged on the same substrate with the temperature control means, more accurate control can be performed, and the above-mentioned effect becomes more pronounced.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed:

1. A temperature regulating system for a fusing device in an image forming apparatus, comprising:

a fusing device having a thermal roller, a heater disposed within said thermal roller, a press roller substantially parallel to and engaged with said thermal roller, said thermal roller and said press roller configured for receiving and heating individual sheets of paper, one sheet of paper at a time, and transporting said one sheet of paper completely through said fusing device;

a means for sensing a surface temperature of said thermal roller, said means for sensing consisting of a single temperature sensor disposed proximate said thermal roller;

a controller having a central processing unit, said controller being connected to random-access memory, read only memory, said heater and said first temperature sensor, wherein said random-access memory is configured to store temperature values sensed by said single temperature sensor and said read-only memory is configured to store a temperature regulating table; and a heater driver connected to said heater and to said controller, wherein said controller and said single temperature sensor are configured to sense and store in said random-access memory a surface temperature (A) of said thermal roller and a surface temperature (B) of said thermal roller in response to said sheet of paper being transported through said fusing device, said surface temperature (A) being sensed for said sheet of paper entering said fusing device and said surface temperature (B) being sensed for said sheet of paper exiting said fusing device; and said controller being configured to evaluate a value corresponding to a difference (A)–(B) between said surface temperature (A) and said surface temperature (B), against said temperature regulating table stored in said read-only memory, and determine a heater driver target value in response to each said sheet of paper being transported through said fusing device;

said heater driver being configured to control said heater in response to said heater driver target value determined by said controller to actuate said heater selectively such that said thermal roller is maintained at a predetermined operating temperature in response to each said sheet of paper being transported through said fusing device.

2. The temperature regulating system as in claim 1, wherein said temperature regulating table in said read-only memory comprises thermal roller surface temperature data corresponding to said surface temperatures (A) and (B), said difference (A–B), and predetermined data correlating the values (A) and (A–B) with a presumed atmospheric temperature value, wherein said heater driver target value for regulating said heater driver is determined based upon the presumed atmospheric temperature value and a comparison of sensed values of said surface temperatures (A) and (B) with said thermal roller surface temperature data.

3. A temperature regulating system for a fusing device in an image forming apparatus according to claim 1, wherein said temperature regulating table in said read only memory includes data corresponding to presumed atmospheric temperature data that is based upon (A) and (B) temperature values, and said controller providing a heater target value which target value is lowered and raised in correspondence with a comparison of the presumed atmospheric value with a preset presumed atmospheric value.

4. A temperature regulating system for a fusing device in an image forming apparatus according to claim 1, further comprising a second temperature sensor for detecting an image forming apparatus interior ambient temperature, wherein said read-only memory is further configured to store a humidity compensating table, said controller and said second temperature sensor are configured to sense and store in said random-access memory the image forming apparatus interior ambient temperature (C) when said controller and said first temperature sensor have sensed and stored the temperature (B), and said controller further evaluates (A–B) against said humidity compensating table for determining said heater driver target value.

5. A temperature regulating system for a fusing device in an image forming apparatus according to claim 4, wherein said temperature regulating table in said read-only memory is configured to store data values for correspondence with the value (A–B) and to store predetermined data correlating the values (A–B) and (C) with a presumed measure of ambient humidity; the target value for regulating said heater driver being further determined based upon a presumed measure of ambient humidity accordingly selected by said controller.

6. A temperature regulating system for a fusing device in an image forming apparatus according to claim 4, wherein said second temperature sensor is disposed adjacent to said controller.

7. A temperature regulating system for a fusing device in an image forming apparatus according to claim 1, wherein said thermal roller represents a sole means of heating in said fusing device.

8. A method for regulating temperature of a thermal roller in a fusing device in an image forming apparatus, comprising the steps of:

(a) heating a thermal roller in a fusing device to a predetermined temperature;

(b) transporting a single sheet of paper completely through the fusing device;

(c) sensing a first temperature of the thermal roller just prior to (b);

(d) sensing a second temperature of the thermal roller immediately after the single sheet of paper is transported through the fusing device;

(e) determining the difference between the first temperature and the second temperature;

(f) comparing the difference with stored values;

(g) determining a heater driver target value based upon said comparison and a presumed atmospheric temperature;

(h) providing heater control to a heater within the thermal roller;

(i) repeating steps (b)–(h) for each sheet of paper transported through the fusing device.

9. The method for regulating temperature, as set forth in claim 8 further comprising the steps:

after step (e), measuring ambient temperature inside an image producing device and determining the humidity within the image producing device based upon the first and second temperatures and the ambient temperature; and in step (g) determining the heater driver target value based also upon the determined humidity.

10. The method for regulating temperature, as set forth in claim 9, wherein measuring ambient temperature inside an image producing device is carried out at a location removed from said fusing device.

11. The method for regulating temperature, as set forth in claim 10, wherein measuring ambient temperature occurs in an area adjacent said controller.

12. The method for regulating temperature, as set forth in claim 10, wherein sensing the first and second temperatures of said thermal roller for each of said sheets of paper is carried out solely by a single temperature sensor unit.

13. The method for regulating temperature, as set forth in claim 12, wherein heating of said thermal roller and an adjacent press roller in said fusing device is carried out solely by the heater positioned within said thermal roller.

14. A temperature regulating system for a fusing device in an image forming apparatus, comprising:

a fusing device having a thermal roller, a heater disposed within said thermal roller, a press roller substantially parallel to and engaged with said thermal roller, said thermal roller and said press roller configured for receiving and heating individual sheets of paper, one sheet of paper at a time, and transporting said one sheet of paper completely through said fusing device;

a single temperature sensor disposed for sensing a temperature of said thermal roller and representing a sole temperature sensor associated with said fusing device;

a controller having a central processing unit, said controller being connected to random-access memory, read only memory, said heater and said first temperature sensor, wherein said random-access memory is configured to store temperature values sensed by said single temperature sensor and said read-only memory is configured to store a temperature regulating table; and a heater driver connected to said heater and to said controller, wherein said controller and said single temperature sensor are configured to sense and store in said random-access memory a surface temperature (A) of said thermal roller and a temperature (B) of said thermal roller for each sheet of paper being transported through said fusing device, said surface temperature (A) being sensed for each of said sheets of paper entering said fusing device and said surface temperature (B) being sensed for each of said sheets of paper exiting said fusing device; and said controller being configured to evaluate, for each sheet of paper, a value corresponding to a difference (A)–(B) between said surface temperature (A) and said surface temperature (B), against said temperature regulating table stored in said read-only memory, and determine a heater driver target value in response to each of said sheets of paper being transported through said fusing device;

said heater driver being configured to control said heater in response to said heater driver target value determined by said controller to actuate said heater selectively such that said thermal roller is maintained at a predetermined operating temperature in response to each of said sheets of paper being transported through said fusing device.

15. A temperature regulating system as recited in claim 14 wherein said temperature regulating table includes predetermined data correlating the values (A) and (A–B) with a presumed atmospheric temperature value.

16. A temperature regulating system as recited in claim 14 further comprising a second temperature sensor for detecting an image forming apparatus interior ambient temperature removed from said fusing device, and wherein said read-only memory is further configured to store a humidity compensating table and said controller further evaluates (A–B) against said humidity table for use in determining said heater target value.

* * * * *